United States Patent [19]

Hughes

[11] Patent Number: 4,823,965

[45] Date of Patent: Apr. 25, 1989

[54] CORD WOOD RACK AND CARRIER

[76] Inventor: Gordon Hughes, 1601 N. Rhodedendron, Apt. 527, Florence, Oreg. 97439

[21] Appl. No.: 113,001

[22] Filed: Oct. 27, 1987

[51] Int. Cl.[4] ..... A47F 7/00

[52] U.S. Cl. ..... 211/60.1; 211/49.1; 211/200; 294/152; 294/153; 294/156

[58] Field of Search ..... 211/49.1, 60.1, 200; 248/164, 166; 294/149, 150, 151, 152, 153, 156

[56] References Cited

U.S. PATENT DOCUMENTS

| | | | |
|---|---|---|---|
| 340,303 | 4/1886 | Fransson | 294/152 |
| 2,397,433 | 3/1946 | Reeves | 294/156 |
| 3,481,519 | 12/1969 | Snetselaar | 294/153 X |
| 4,223,818 | 9/1980 | Johnson | 211/60.1 X |
| 4,469,341 | 9/1984 | Creim | 211/60.1 X |

FOREIGN PATENT DOCUMENTS

| | | | |
|---|---|---|---|
| 2419300 | 11/1975 | Fed. Rep. of Germany | 248/164 |

*Primary Examiner*—Robert W. Gibson, Jr.
*Attorney, Agent, or Firm*—Leon Gilden

[57] ABSTRACT

A portable compactly stored cord rack and carrier assembly is set forth. A flexible wood carrier formed of canvas or leather-like material is provided with opposed handles at terminal ends thereof and supportably enables transport of firewood whereby the accompanying foldable rack provides cradled support thereof. Said rack comprises a scissor-like pair of pivoted framework members formed with flexible strap elements securing opposed horizontal structural portions for support and reinforcement of the firewood carrier.

5 Claims, 3 Drawing Sheets

CORD WOOD RACK AND CARRIER

BACKGROUND OF THE INVENTION

1. Field of the Invention

The present invention relates to firewood carriers and supports and more particularly pertains to a new and improved firewood carrier/support device which, when not being utilized, may be folded into a compact size for transport or storage of same.

2. Description of the Prior Art

The use of firewood carriers and the like is well known in the prior art. As may be appreciated, these devices have normally required a substantial amount of space and as such it is desirable to store the devices when they are not being utilized. Furthermore, a support device for a firewood carrier must be of substantial structure to enable support of the relatively heavy load firewood comprises. In this connection there have been several attempts to develop firewood carriers and the like which may be easily and efficiently transported and stored. For example, U.S. Pat. No. 340,303 to Fransson illustrates a pair of linear supports wherein a looped canvas-like material with a back stop "B" formed at the central edge thereof maintains firewood positioned for support thereof. The carrier of Fransson fails to provide any means for support of the flexible carrier when transport is concluded. Accordingly, wood supported thereby is subject to rolling after being deposited, creating hazard and debris at the termination of the transport procedure.

U.S. Pat. No. 935,364 to Gillespie illustrates a flexible basket-like member formed of joined end portions creates a flexible basket-like arrangement for transport of wood. The Gillespie patent fails to provide a means that is easily folded and concealed when not in use.

U.S. Pat. No. 1,118,519 to Weaver sets forth another flexible wood carrier formed essentially of an interlinked chain with linear rods providing a skeleton framework to support a chain organization for carriage of firewood.

U.S. Pat. No. 1,971,322 to Miller, U.S. Pat. No. 2,397,433 to Reeves and U.S. Pat. No. 2,427,246 to Whittington are similar in nature and essentially comprise a flexible central portion with support handles thereon for transport of firewood and the like. Again, the problem of easily transporting the carrier and its final positioning at the termination of transport is not addressed whereas, as noted, the absence of a cooperating cradling mechanism is necessary in avoiding the hazards and the debris associated with firewood usage.

As such, it may be appreciated that there is continuing need for new and improved wood rack and carrier apparatus which addresses both the problem of portability and storage, and in this respect, the present invention substantially fulfills this need.

SUMMARY OF THE INVENTION

In view of the foregoing disadvantages inherent in the known types of wood rack and carriers now present in the prior art, the present invention provides an wood rack and carrier wherein the same may be compactly stored when not in use and may be further easily and efficiently transported and presented during periods of need. As such, the general purpose of the present invention, which will be described subsequently in greater detail, is to provide a new and improved wood rack and carrier which has all the advantages of the prior art wood racks and carriers and none of the disadvantages.

To attain this, the present invention comprises a flexible central support band formed with transverse support rods confined within terminal ends of said carrier with handles secured thereto for transport of firewood. A compactly foldable rack formed of plural rectangular frames are pivotally secured together in a scissor-like action to enable storage of same in a flattened condition and scissoring open of the assembly to accept positioning of the wood carrier therein on spanning straps secured to lateral terminal framework end portions for support of a carrier at one end and reinforcement of a support rack at the other end when loaded by the carrier.

My invention resides not in any one of these features per se, but rather in the particular combination of all of them herein disclosed and claimed and it is distinguished from the prior art in this particular combination of all of its structures for the functions specified.

There has thus been outline, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is of enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved wood rack and carrier which has all the advantages of the prior art wood racks and carriers and none of the disadvantages.

It is another object of the present invention to provide a new and improved wood rack and carrier which may be easily and efficiently manufactured and marketed.

It is a further object of the present invention to provide a new and improved wood rack and carrier which is of a durable and reliable construction.

An even further object of the present invention is to provide a new and improved wood rack and carrier which is susceptible of a low cost of manufacture with regard to both materials and labor, and which accordingly is then susceptible of low prices of sale to the consuming public, thereby making such wood racks and carriers economically available to the buying public.

Still yet another object of the present invention is to provide a new and improved wood rack and carrier which provides in the apparatuses and methods of the prior art some of the advantages thereof, while simultaneously overcoming some of the disadvantages normally associated therewith.

Still another object of the present invention is to provide a new and improved wood rack and carrier wherein a support rack is formed of pivotally mounted frames to provide a scissor-like framework for compact storage and opening thereof.

Yet another object of the present invention is to provide a new and improved wood rack and carrier wherein the carrier portion of the combination is formed of a flexible band with rigid rod-like elements positioned at terminal ends thereof for securement handles thereto for transport of said carrier.

Even still another object of the present invention is to provide a new and improved wood rack and carrier wherein plural strapping is provided to secure both terminal end sections of said respective frames together for support of the carrier and for reinforcement of the rack when loaded by the carrier.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
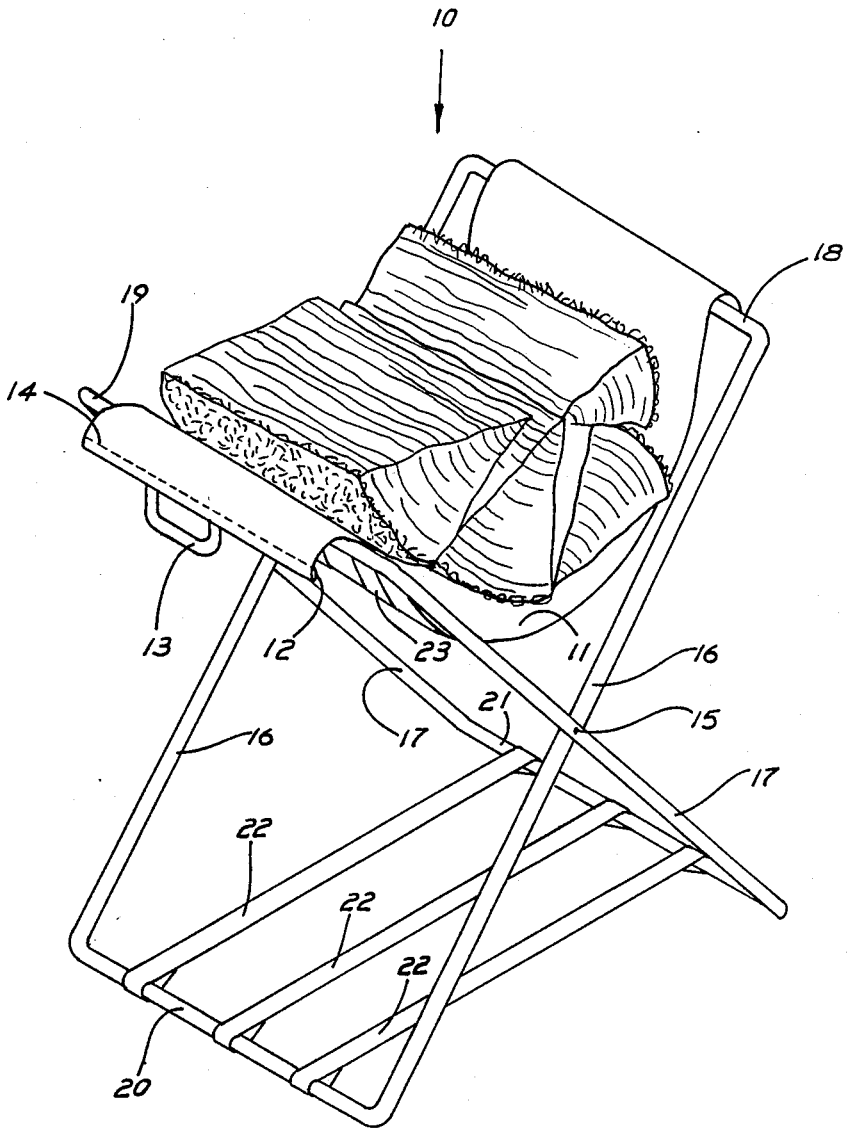
FIG. 1 is an isometric view of the wood rack and carrier comprising the present invention.

With reference now to the drawings, and in particular to FIG. 1 thereof, a new and improved wood rack and carrier embodying the principles and concepts of the present invention and generally designated by the reference numeral 10 will be described.

More specifically, it will be noted that the wood rack and carrier 10 essentially comprises a conventional carrier formed of a central flexible support band 11. Generally a canvas or leather-like material is utilized in the formation of central band 11. Positioned within terminal end portions of said flexible band 11 are linear support rods 12 positioned within over-sewn seams 14 on either end. A handle 13 is formed to said support rod 12. Only the left side of the support band 11 is illustrated per FIG. 1 but the other side (not shown) is identical and further illustration is not deemed necessary.

The wood rack portion of the instant invention comprises a pair of rectangular frames pivotally secured together in a scissor-like manner by use of respective pivots 15 on either side of the intersection of first and second pair of vertical links 16 and 17 respectively. The vertical links 16 and 17 terminate in first and second upper links 18 and 19 and first and second lower links 20 and 21, as illustrated. Links 16 and 17 are dimensioned to be of a greater lineal length than respective links 18 and 19 by a ratio of 2/1 to 4/1 to provide an adequately elevated support surface. Links 16 and 17 are therefore to be of three to four feet in length.

The wood rack and carrier apparatus 10 further comprises lower web members 22 securing said first and second lower links 20 and 21 together to reinforce the structure and integrity of the rack when loaded, as illustrated in FIG. 1. Upon upper web members 23 provide the support required on accommodation of the carrier member. Upper and lower web members are secured about their respective links and may be sewn or bonded together to form loops about the respective links members.

Figure 2:
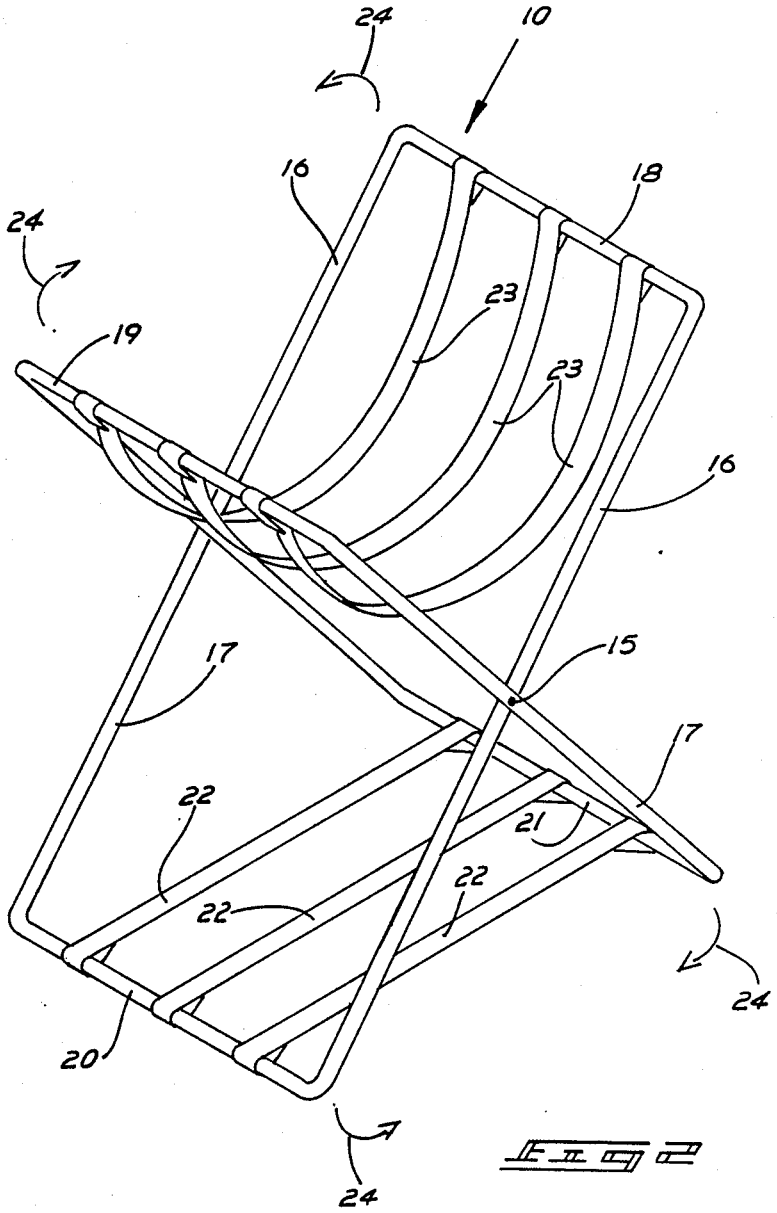
FIG. 2 is an isometric view of the present invention illustrating the wood rack during folding thereof.
Figure 3:
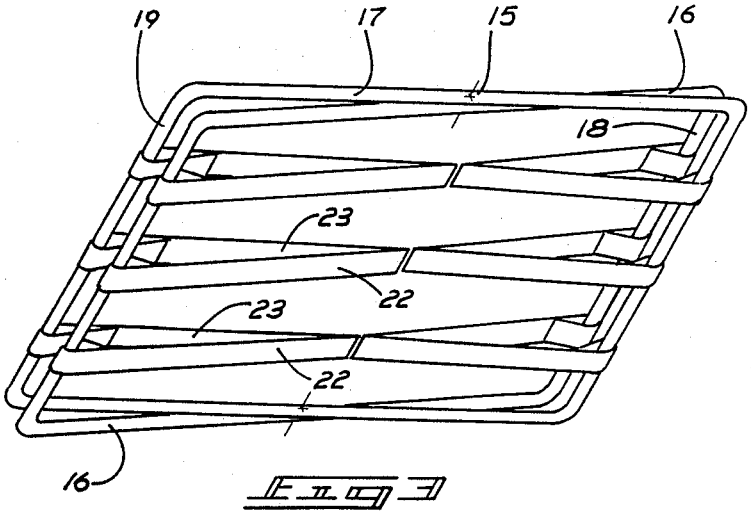
FIG. 3 is an isometric view of the wood rack of the present invention in an interfolded orientation.
Figure 4:
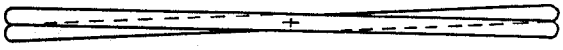
FIG. 4 is an orthographic side view of the wood rack of FIG. 3 illustrating the interfolded orientation.
Figure 5:
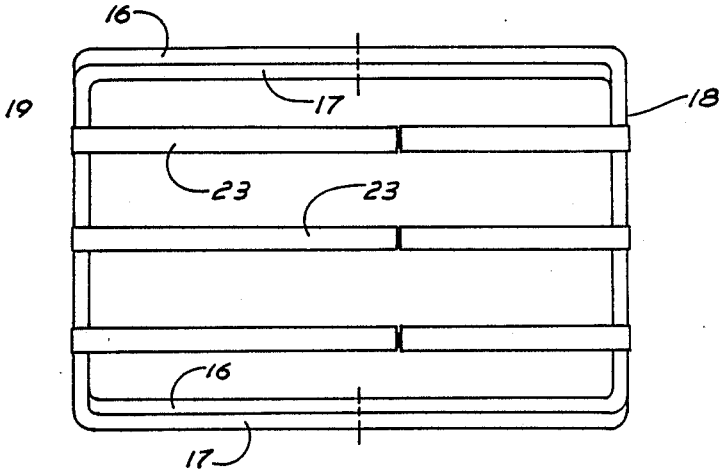
FIG. 5 is an orthographic top view of the wood rack of the present invention in an interfolded orientation.

For storage of the rack when use is not desired, the rack may be interfolded initially as illustrated in FIG. 2 in the direction of arrows 24. When so manipulated, the rack presents a compact unitary structure of a planar-like configuration, as illustrated in FIGS. 3, 4 and 5. The carrier accordingly also formed of a flexible organization may be folded and stored with a rack to form a compact storage unit.

The wood rack and carrier thereby presents a means for not only the transport of firewood when desired, but includes a support surface means therefore to prevent the random rolling of such firewood pieces, as illustrated in FIG. 1, during normal usage by the cradling of the carrier, primarily as illustrated in FIG. 1.

As to the manner of usage and operation of the present invention, the same should be apparent from the above description. Accordingly, no further discussion relative the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A wood rack and carrier for the transport and securement of firewood comprising, a carrier means for transporting firewood wherein said carrier means comprises a flexible band including a first and second terminal end and further including support rods secured at said first and second terminal ends, handle elements securable to said rod elements for transport of said carrier means, and said carrier means nestable within a rack means for supporting said firewood and carrier and preventing its repositioning when nested, said rack means including a plurality of rectangular frame members pivotally secured together to pivot in a scissor-like manner, said rack means including a plurality of reinforcement elements and support elements, said reinforcement elements spanning and securing said rectangular frame members at respective lower terminal portions and said support elements spanning terminal ends of said rectangular frame members remote from said lower terminal portions.

2. A wood rack and carrier as set forth in claim 1 wherein said rectangular frame members are each formed in horizontal members and vertical members wherein said vertical members are of a greater linear dimension than said horizontal members.

3. A wood rack and carrier as set forth in claim 2 wherein said support elements and reinforcement elements span and secure together said horizontal members of respective rectangular frame members.

4. A wood rack and carrier as set forth in claim 3 wherein at least three support elements and three reinforcement elements are utilized.

5. A wood rack and carrier as set forth in claim 4 wherein said vertical members are 3 to 4 feet in length and are at least twice the lineal dimensions of said horizontal members but wherein said vertical members are of a length not to exceed four times the lineal dimension of said horizontal members.

* * * * *